US007007624B1

(12) United States Patent
Miller

(10) Patent No.: US 7,007,624 B1
(45) Date of Patent: Mar. 7, 2006

(54) TRANSPORTABLE AND CONFIGURABLE CAMEL AND SHIP SEPARATOR SYSTEM

(75) Inventor: Bryan L. Miller, Hardyville, VA (US)

(73) Assignee: Miller Marine, Inc., Deltaville, VA (US)

( * ) Notice: Subject to any disclaimer, the term of this patent is extended or adjusted under 35 U.S.C. 154(b) by 0 days.

(21) Appl. No.: 11/070,930

(22) Filed: Mar. 3, 2005

(51) Int. Cl.
*B63B 35/44* (2006.01)

(52) U.S. Cl. ..... 114/264; 114/219; 405/212

(58) Field of Classification Search ..... 114/219, 114/220, 264, 266; 405/212, 215, 220
See application file for complete search history.

(56) References Cited

U.S. PATENT DOCUMENTS 2,120,545 A * 6/1938 Buckton ..... 114/219
2,426,345 A * 8/1947 Dosker ..... 114/219
4,406,241 A * 9/1983 Comte ..... 405/215
5,766,711 A * 6/1998 Barmakian ..... 114/219
6,591,773 B1 * 7/2003 Chang et al. ..... 114/219

* cited by examiner

*Primary Examiner*—Lars A. Olson
(74) *Attorney, Agent, or Firm*—Peter J. Van Bergen

(57) ABSTRACT

A camel and ship separator support system uses a pontoon having length and width dimensions being commensurate with that of a standard ISO shipping container. A plurality of recesses span the height dimension of the pontoon with pairs of the recesses located at opposing portions of the pontoon with respect to the width dimension thereof. H-shaped leg assemblies are coupled to the pontoon at the pontoon's recesses. Each leg assembly extends beyond the height dimension of the pontoon while remaining within the length and width dimensions of the pontoon. A support assembly is fitted between and coupled to adjacent leg assemblies. Fenders can be coupled to the leg assemblies to thereby form a camel or ship separator.

20 Claims, 6 Drawing Sheets

TRANSPORTABLE AND CONFIGURABLE CAMEL AND SHIP SEPARATOR SYSTEM

FIELD OF THE INVENTION

The invention relates generally to marine camels and ship separators, and more particularly to a universal camel and ship separator system that is easily transported and configured for a variety of camel and separator applications.

BACKGROUND OF THE INVENTION

Camels are bumpers or buffers between a surface ship/submarine and a pier. Ship separators are bumpers or buffers between two ships, two submarines, or a ship and a submarine. Owing to the wide variety of pier constructions, hull sizes and shapes, and/or ship/submarine waterlines, camels and ship separators have traditionally been designed for specific locations and/or specific ship configurations. This means that a particular port must stock a number of different camels and ship separators to handle what typically is an ever changing pier occupancy. Obviously, this leads to increased port expenses. Furthermore, the transporting and changing of the camels and/or ship separators is time consuming, costly and dangerous owing to their size and weight.

SUMMARY OF THE INVENTION

Accordingly, it is an object of the present invention to provide a combination camel and ship separator system that can be configured for a variety of applications.

Another object of the present invention is to provide a camel and ship separator system that can easily be transported from location to location, and then configured for a variety of applications.

Still another object of the present invention is to provide a camel and ship separator support system that can have a variety of fenders coupled thereto in a variety of configurations.

Other objects and advantages of the present invention will become more obvious hereinafter in the specification and drawings.

In accordance with the present invention, a camel and ship separator support system uses a pontoon having length, width and height dimensions with the length and width dimensions being commensurate with that of a standard ISO shipping container. The pontoon has corners defined by ISO container fittings. A plurality of recesses span the height dimension of the pontoon with pairs of the recesses located at opposing portions of the pontoon with respect to the width dimension thereof. A plurality of leg assemblies are coupled to the pontoon. Each leg assembly is substantially H-shaped (i) with at least two vertical members coupled to one another by at least one horizontal member, and (ii) with portions of the vertical members coupled to the pontoon at the pontoon's recesses associated with one pair thereof while being fitted within the confines of the recesses. Each leg assembly extends beyond the height dimension of the pontoon while remaining within the length and width dimensions of the pontoon. A support assembly is fitted between and coupled to adjacent ones of the leg assemblies at portions thereof that extend beyond the height dimension of the pontoon. Fenders can be coupled to the camel and ship separator support system at it's vertical members.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
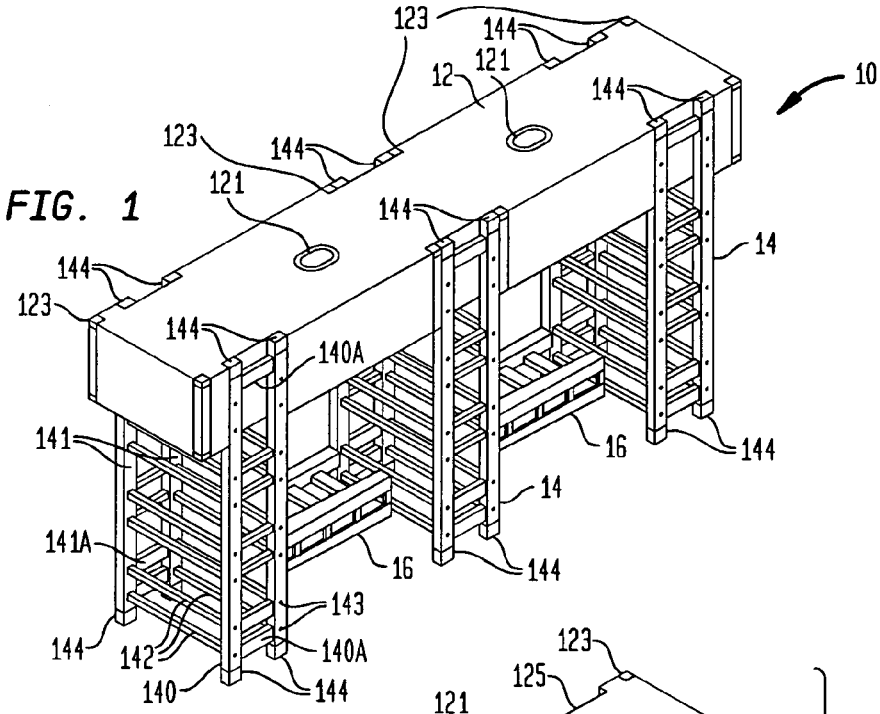
FIG. 1 is a perspective view of a camel and ship separator support system in accordance with the present invention.

Referring now to the drawings, simultaneous reference will be made to FIGS. 1–2 where an embodiment of a camel and ship separator support system in accordance with the present invention is illustrated and is referenced generally by numeral 10. As will be described further herein, system 10 is easily transportable and configurable for utilization as either a camel (i.e., between a pier and a ship or submarine) or a ship separator (i.e., between two ships, two submarines, or a ship and a submarine).

System 10 includes three basic elements: a pontoon 12, vertically-oriented leg assemblies 14, and horizontally-oriented spacer/support assemblies 16. Each of these elements, as well as coupling elements (not shown) used to join the elements, will be made from materials that can withstand (or can be treated to withstand) extended use in a marine environment. Such materials are well known in the art. Accordingly, it is to be understood that the choice of materials and/or material treatments are not limitations of the present invention.

Figure 3:
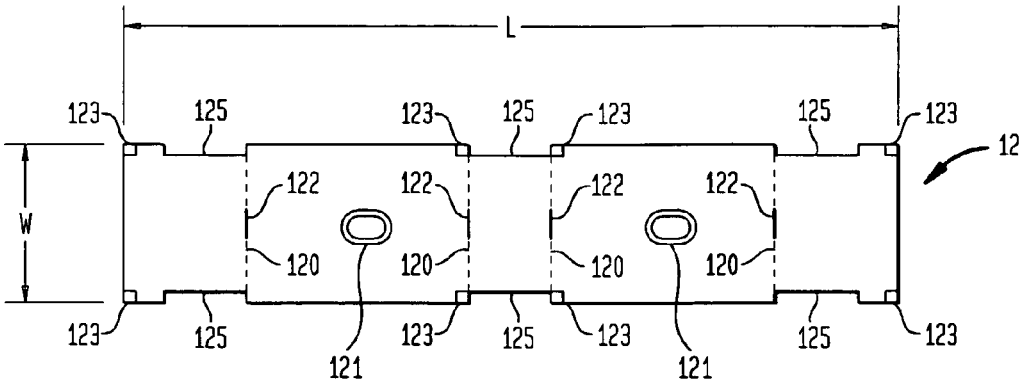
FIG. 3 is an isolated top plan view of the pontoon.
Figure 4:
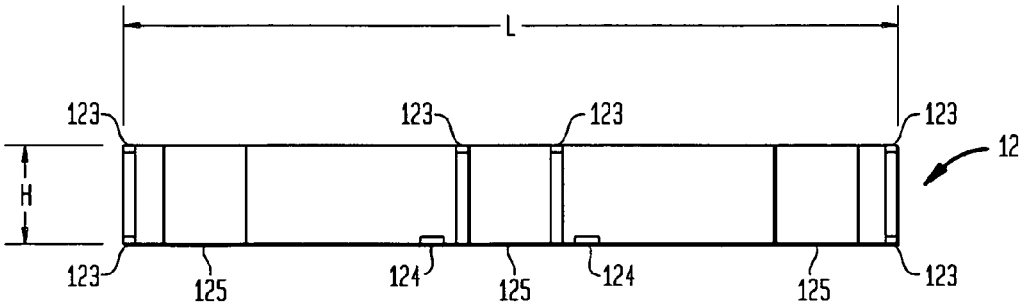
FIG. 4 is an isolated side view of the pontoon.

Referring additionally now to FIGS. 3–4, pontoon 12 is a generally rectangular-box shaped floating structure having outer length (L), width (W) and height (H) dimensions. The length and width dimensions of pontoon 12 are equal to that of a standard ISO shipping container, i.e., either 20 or 40 feet in length and 8 feet in width. In the illustrated example, pontoon 12 is 40 feet in length. The height of pontoon 12 is generally less than the 8 foot height of an ISO container, and should be such that system 10 with fenders (not shown) coupled thereto remains buoyant.

Pontoon 12 is essentially a hollow structure that can have a plurality of solid bulkheads formed therein to compartmentalize the interior thereof. Such compartmentalization allows pontoon 12 to retain its buoyancy even if a leak develops. The bulkheads are illustrated by dashed lines 120 in FIG. 3. Access to the interior of pontoon 12 (e.g., for repair, storage, etc.) is made possible by one or more hatches 121. Additional hatches 122 can be provided in bulkheads 120 to permit access to the various compartments of pontoon 12. Each corner of pontoon 12 is defined by an ISO container fitting 123, the design of which is well understood in the art. In addition, for reasons that will be explained further below, additional ISO container fittings 123 (e.g., four are illustrated) can be provided along the top edge of pontoon 12. Pontoon 12 can also have pockets 124 formed in the bottom central portion thereof (FIG. 4) for receiving the fork (not shown) of a lifting mechanism such as a fork lift, etc.

Pontoon 12 has a plurality of recesses 125 formed therein with each of recesses 125 spanning the pontoon's entire height dimension. More specifically, recesses 125 are formed in mirror-image opposing relation to one another across the width dimension of pontoon 12. Each pair of opposing recesses 125 forms the mounting region for one of leg assemblies 14.

Each of leg assemblies 14 is identically configured such that a description of only one leg assembly 14 is needed. In general, leg assembly 14 is substantially an H-shape with its vertical "legs" disposed on either side of pontoon 12 and its horizontal "member(s)" coupling the legs to one another. In the illustrated embodiment, vertical legs 140 comprise one side of the "H" and vertical legs 141 comprise the other side of the "H". Spacing between the vertical legs 140 is maintained by spacers 140A and spacing between vertical legs 14 is maintained by spacers 141A. Vertical legs 140 and 141 are coupled to one another by horizontal members 142. The number and exact placement of horizontal members 142 can be adjusted to satisfy loading requirements.

Figure 2:
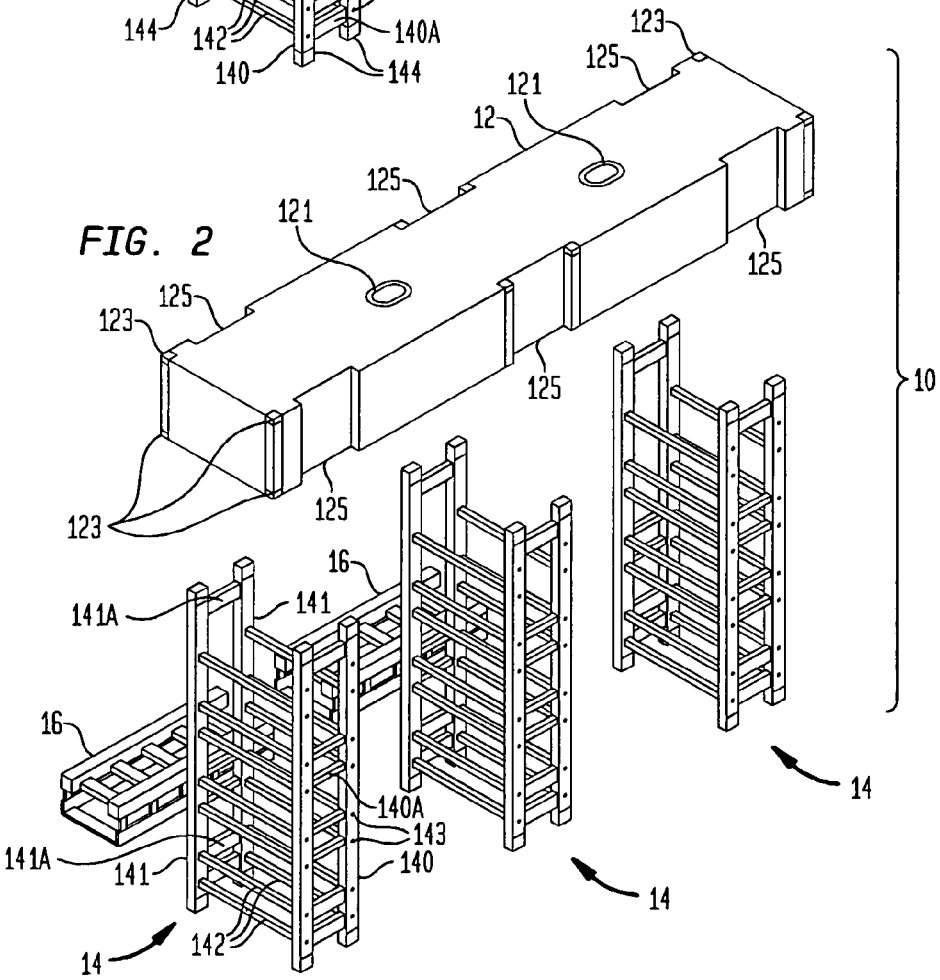
FIG. 2 is an exploded view of the system shown in FIG. 1.

Leg assembly 14 is dimensioned such that opposing portions of vertical legs 140 and 141 fit in an opposing pair of recesses 125 as illustrated in FIG. 1. That is, these portions of vertical legs 140 and 141 fit fully within the confines of recesses 125 so that the length and width of leg assemblies 14 fit within the length and width dimensions of pontoon 12 while the remaining portion of leg assembly 14 extends beyond the height dimension of pontoon 12. To facilitate the packing and transportation of system 10 which will be explained in greater detail below, each of leg assemblies 14 should have a height dimension that does not exceed 20 feet. Attachment of vertical legs 140 and 141 to pontoon 12 at recesses 125 can be by any conventional means. If needed, horizontal supports (not shown) can be provided in pontoon 12 to span between recessed 125, and could be coupled to vertical legs 140 and 141.

Each of vertical legs 140 and 141 has holes 143 provided therethrough to facilitate the mounting of fenders (not shown) thereto as will be explained further below. The pattern formed by holes 143 is the same on each of vertical legs 140 and 141. Further, since each of leg assemblies 14 is identical, when leg assemblies 14 are attached to pontoon 12, all of vertical legs 140 lie in one plane on one side of pontoon 12 while all of vertical legs 141 lie in another plane on the other side of pontoon 12. Thus, holes 143 in vertical legs 140 and 141 define identical patterns or arrays of holes that will be used to mount fenders as will be explained further below.

Figure 5:
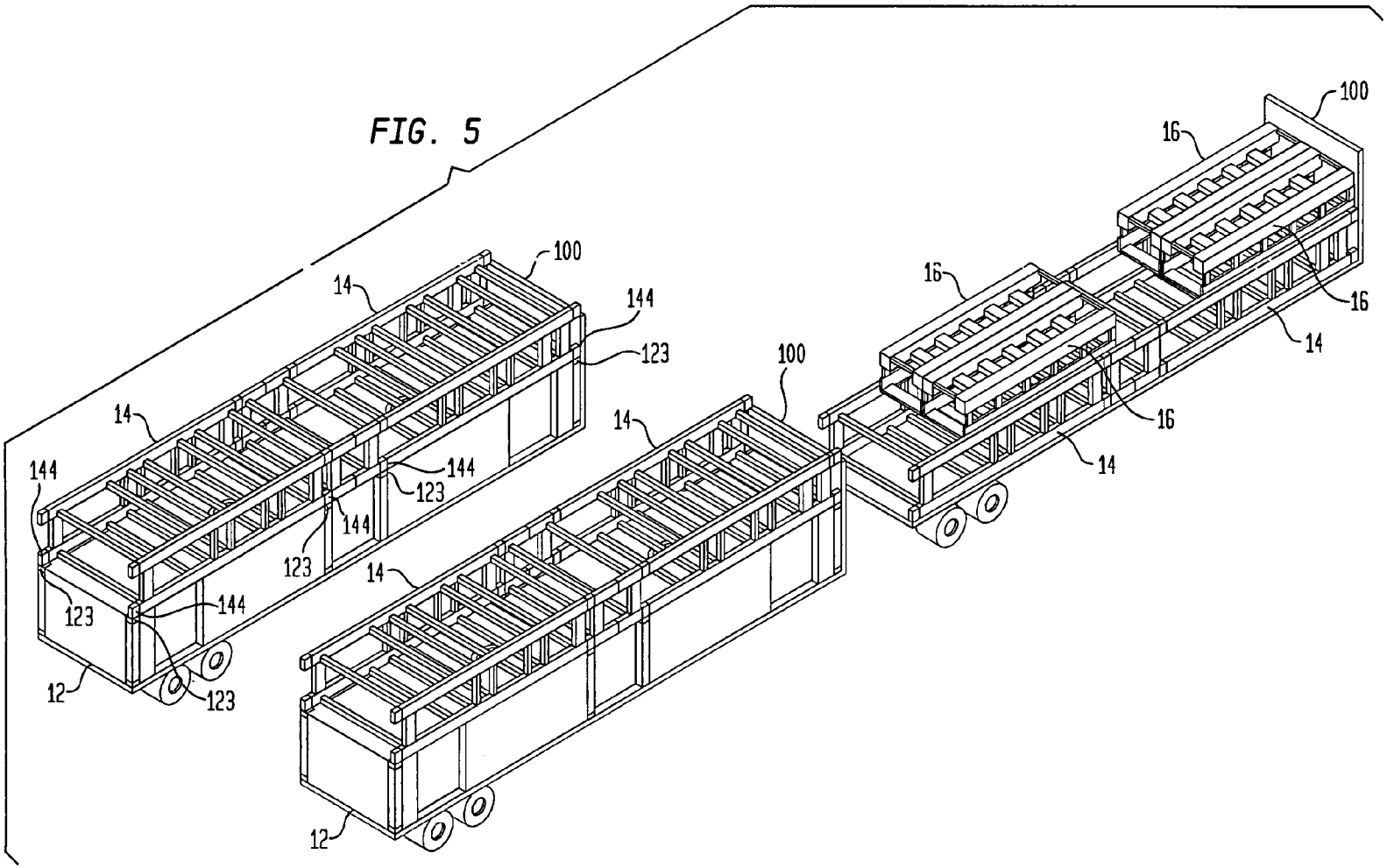
FIG. 5 is a perspective view of one possible transportation arrangement for two of the camel and ship separator support systems of the present invention.

Each of vertical legs 140 and 141 can also have ISO container fittings 144 (FIG. 1) incorporated therein and therealong to permit leg assembly 14 to be attached to pontoon 12 for transportation. That is, as will be explained further below, leg assembly 14 can be laid horizontally on top of pontoon 12 and fastened thereto by using aligned ones of ISO container fittings 123 and 144. Accordingly, the particular placement of fittings 144 will be predicated on the placement of fittings 123 and is not limited to the placement illustrated in FIG. 1 as will become evident when FIG. 5 is described. Further, for clarity of illustration, ISO container fittings 144 are only referenced in FIGS. 1 and 5. However, it is to be understood that fittings 144 can be included where needed on each of leg assemblies 14 in all other embodiments and figures described herein.

Lateral support between adjacent leg assemblies 14 is provided by a spacer/support assembly 16. More specifically, spacer/support assembly 16 comprises one or more rigid members spanning horizontally between and coupled to adjacent ones of leg assemblies 14. Each spacer/support assembly 16 can be the same and is dimensioned to fit within the width dimensions of pontoon 12. In the illustrated embodiment, the width of each spacer/support assembly 16 (as viewed in the width dimension of pontoon 12) is less than half the width of pontoon 12 in order to facilitate the packing and transportation thereof.

One of the advantages of system 10 is its transportability owing to the unique structure of the pontoon, leg assemblies, and spacer/support assemblies. Accordingly, FIG. 5 illustrates a transportation configuration for a pair of systems 10 that includes two pontoons 12, six leg assemblies 14 and four spacer/support assemblies 16. In particular, these elements are arranged to be transported by three conventional 40-foot, flat-bed trailers 100 that are typically used to transport ISO shipping containers. Each of two trailers 100 has a pontoon 12 with two leg assemblies 14 laid horizontally thereon. Leg assemblies 14 can be secured to pontoon 12 using, for example, that ISO container fittings on pontoon 12 (i.e., fittings 123) that are aligned with ISO container fittings positioned in corresponding locations on leg assemblies 14 (i.e., fittings 144). Conventional ISO connectors (not shown) can be used to couple the aligned ISO container fittings thereby coupling leg assemblies 14 to pontoon 12. A third trailer 100 holds two more of leg assemblies 14 and four of spacer/support assemblies 16.

In addition to it's transportability features, the structure of the present invention allows it to be adapted to a variety of camel or ship separator configurations. Several such configurations are illustrated in FIGS. 6–10. However, it is to be understood that the present invention is not limited to these configurations.

Figure 6:
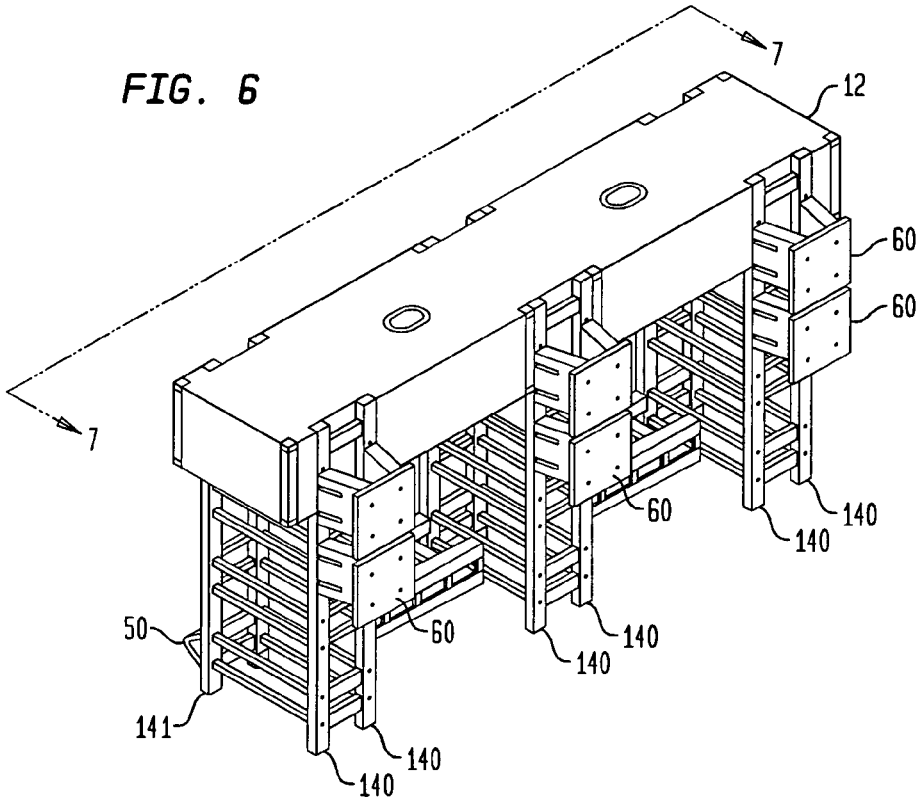
FIG. 6 is a perspective view of an embodiment of a camel configuration in accordance with the present invention.
Figure 7:
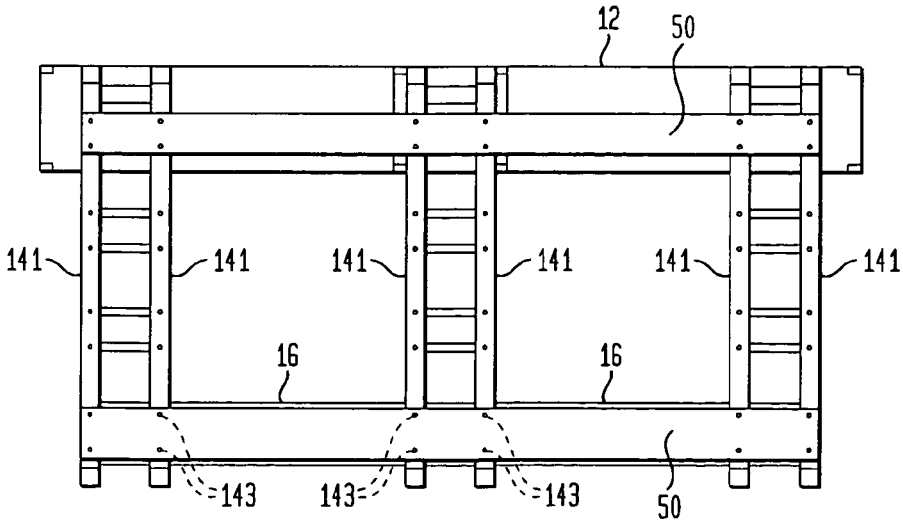
FIG. 7 is a side view of the camel configuration taken along line 7—7 in FIG. 6.

FIGS. 6 and 7 illustrate one possible camel configuration for a surface ship where arch fenders 50 are attached to vertical legs 141 (using selected ones of holes 143) on the pier side of pontoon 12, and V-fenders 60 are attached to vertical legs 140 (using selected ones of holes 143) on the ship side of pontoon 12. Fenders 50 and 60, as well as a variety of other well known fender types, are available from a variety of commercial manufactures such as Svedala Trellex, Keokuk, Iowa.

Figure 8:
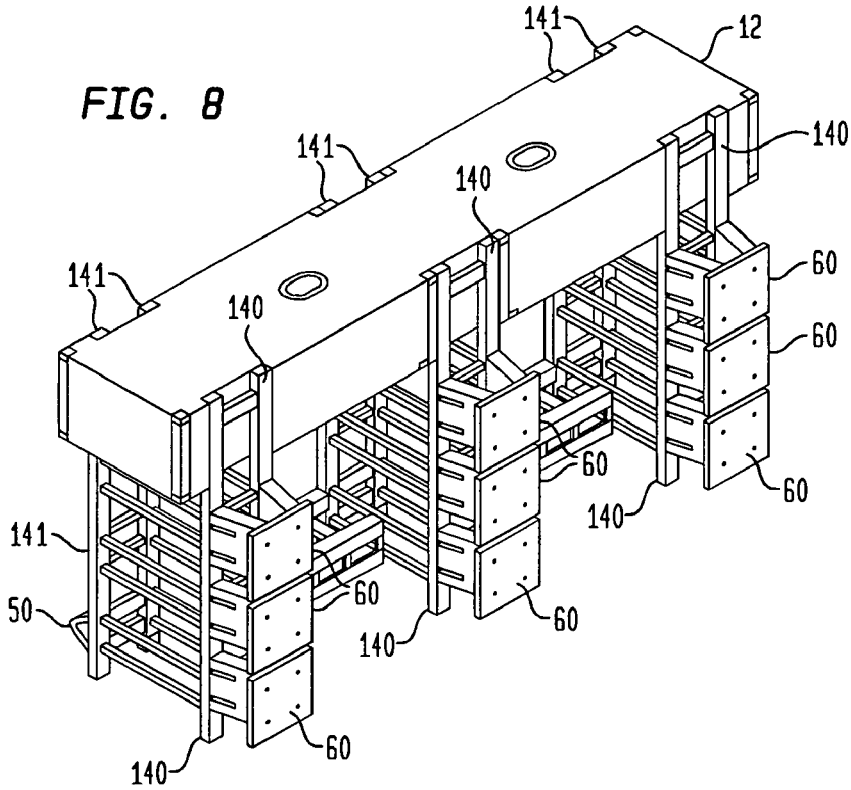
FIG. 8 is a perspective view of another embodiment of a camel configuration.
Figure 9:
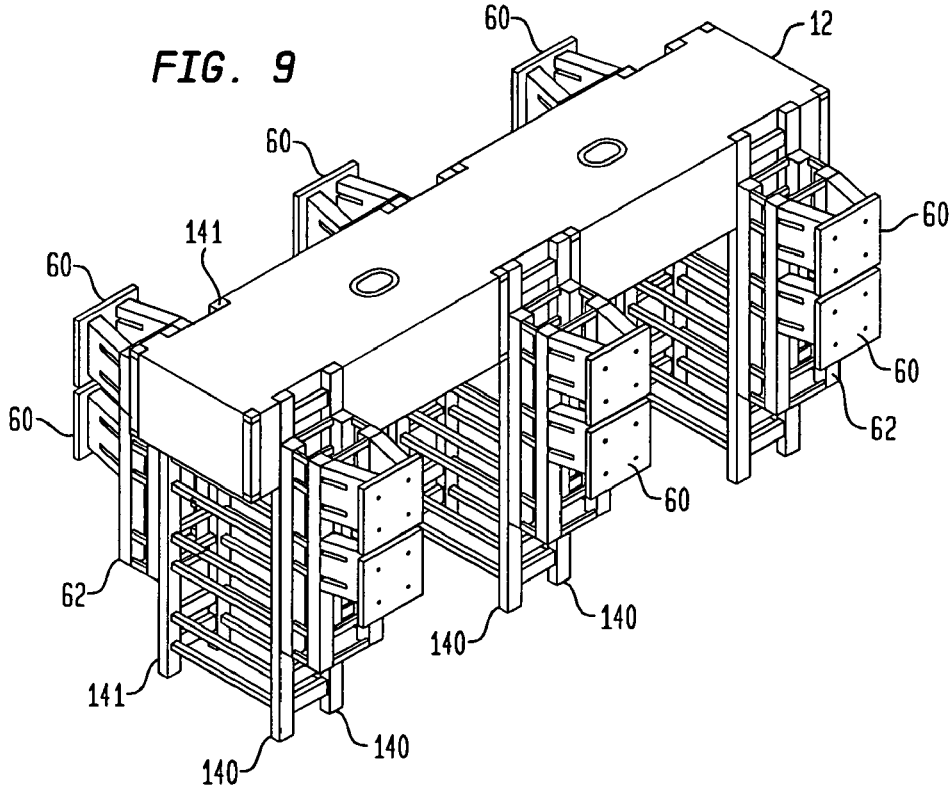
FIG. 9 is a perspective view of an embodiment of a ship separator configuration in accordance with the present invention.
Figure 10:
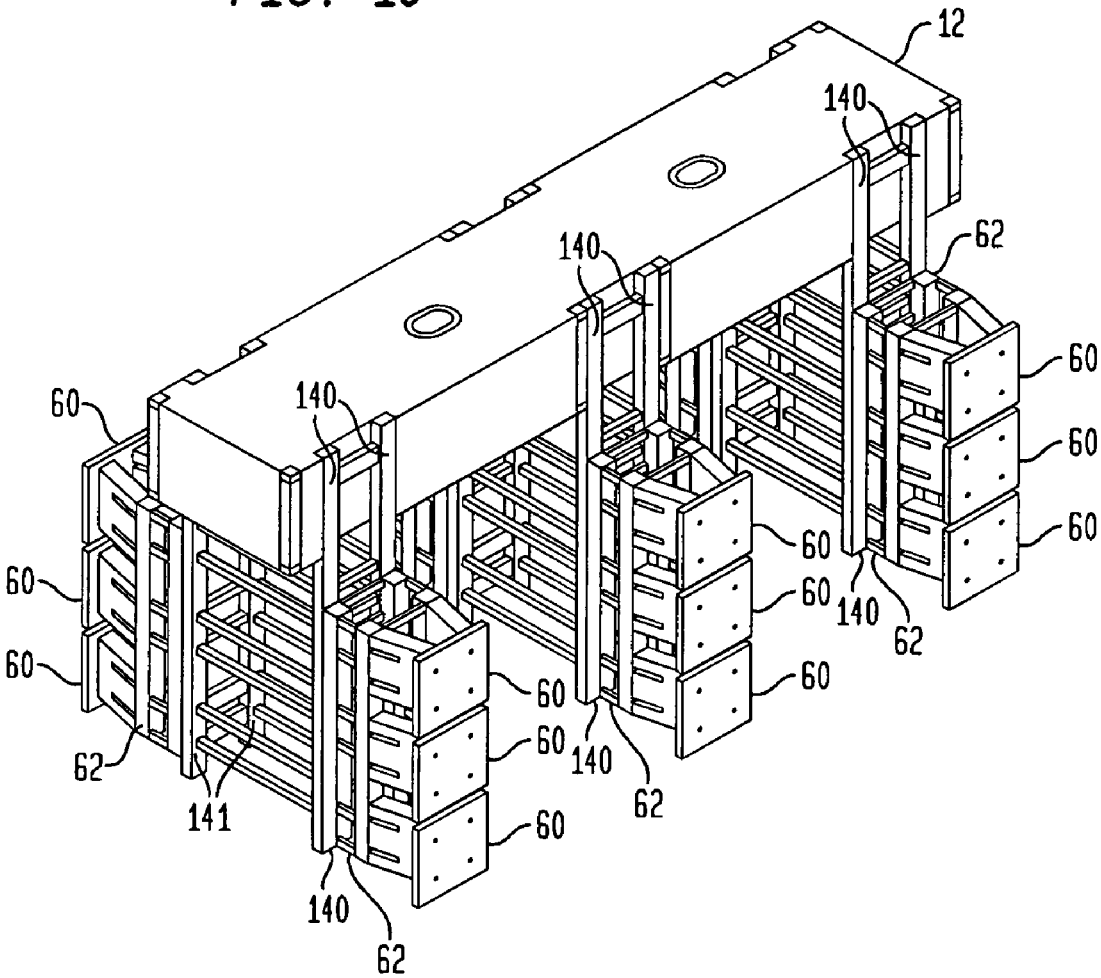
FIG. 10 is a perspective view of another embodiment of a ship separator configuration.

FIG. 8 illustrates another type of camel that might be used with a submarine. Additional V-fenders 60 are used and arranged on the lower portions of vertical legs 140. FIG. 9 illustrates a possible surface ship separator configuration where V-fenders 60 are used on both sides of pontoon 12. That is, V-fenders 60 serve as the contact points between two ships. If additional ship separation is needed, spacer frames 62 can be coupled to vertical legs 140 and 141 with spacer frames 62 then serving as the mounting platform for V-fenders 60. FIG. 10 illustrates another type of ship separator that might be used between two surfaced submarines. More specifically, additional V-fenders 60 can be added and are arranged on the lower portions of vertical legs 140 and 141. Once again, spacer frames 62 can be used to provide additional ship separation. Transportation of entire camel or ship separator systems in accordance with the present invention is carried out in the same fashion as previously described except that an additional trailer would be used to transport the various fenders for a particular application.

The advantages of the present invention are numerous. The structure of the camel and ship separator support system allows it to be readily equipped with a variety of different fenders in a variety of configurations. Thus, the present invention can be adapted to a wide variety of ship-to-pier, submarine-to-pier, ship-to-ship, ship-to-submarine, and/or submarine-to-submarine mooring applications. This is all achieved with a single system thereby allowing a pier or ship to stock just one system that can be adapted to any mooring situation. Further, the structure of the present invention simplifies the transportation and storage of the system.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A camel and ship separator support system, comprising:

a pontoon having length, width and height dimensions, said pontoon having corners defined by ISO container fittings, said pontoon further having a plurality of recesses spanning said height dimension with pairs of said recesses located at opposing portions of said pontoon with respect to said width dimension;

a plurality of leg assemblies coupled to said pontoon, each of said plurality of leg assemblies being substantially H-shaped (i) with at least two vertical members coupled to one another by at least one horizontal member, and (ii) with portions of said vertical members coupled to said pontoon at said recesses associated with one of said pairs thereof while being fitted within the confines of said recesses, wherein each of said plurality of leg assemblies extends beyond said height dimension of said pontoon while remaining within said length and width dimensions of said pontoon; and a support assembly fitted between and coupled to adjacent ones of said plurality of leg assemblies at portions thereof that extend beyond said height dimension of said pontoon.

2. A system as in claim 1 wherein said pontoon comprises a plurality of water-tight compartments.

3. A system as in claim 1 further comprising at least one access hatch provided in said pontoon.

4. A system as in claim 1 wherein said vertical members of each of said plurality of leg assemblies are adapted to have fenders coupled thereto wherein said fenders extend beyond said width dimension of said pontoon.

5. A system as in claim 1 wherein said pontoon has pockets formed therein and centrally positioned along said length dimension thereof, said pockets adapted to receive the fork of a lifting mechanism.

6. A system as in claim 1 further comprising ISO container fittings coupled to said vertical members of each of said plurality of leg assemblies.

7. A system as in claim 1 wherein each of said vertical members has an identical configuration of mounting holes provided therethrough.

8. A camel and ship separator system, comprising:

a pontoon having length, width and height dimensions, said pontoon having at least corners thereof defined by ISO container fittings, said pontoon further having a plurality of recesses spanning said height dimension with mirror image pairs of said recesses located at opposing portions of said pontoon with respect to said width dimension;

a plurality of leg assemblies coupled to said pontoon, each of said plurality of leg assemblies being substantially H-shaped (i) with at least two vertical members coupled to one another by at least one horizontal member, and (ii) with portions of said vertical members coupled to said pontoon at said recesses associated with one of said pairs thereof while being fitted within the confines of said recesses, wherein each of said plurality of leg assemblies extends beyond said height dimension of said pontoon while remaining within said length and width dimensions of said pontoon, and wherein said vertical members coupled to one side of said pontoon lie in a first plane and said vertical members coupled to an opposing side of said pontoon lie in a second plane;

a support assembly fitted between and coupled to adjacent ones of said plurality of leg assemblies at portions thereof that extend beyond said height dimension of said pontoon;

a plurality of first fenders coupled to at least one of said vertical members in said first plane; and a plurality of second fenders coupled to at least one of said vertical members in said second plane.

9. A system as in claim 8 wherein said first fenders and said second fenders are the same type.

10. A system as in claim 8 wherein said first fenders and said second fenders are different types.

11. A system as in claim 8 wherein said pontoon comprises a plurality or water-tight compartments.

12. A system as in claim 8 further comprising at least one access hatch provided in said pontoon.

13. A system as in claim 8 wherein said pontoon has pockets formed therein and centrally positioned along said length dimension thereof, said pockets adapted to receive the fork of a lifting mechanism.

14. A system as in claim 8 further comprising ISO container fittings coupled to said vertical members of each of said plurality of leg assemblies.

15. A system as in claim 8 wherein each of said vertical members has an identical configuration of mounting holes provided therethrough.

16. A camel and ship separator system, comprising:

a pontoon having length, width and height dimensions, said pontoon having at least corners thereof defined by ISO container fittings, said pontoon further having a plurality of recesses spanning said height dimension with pairs of said recesses located at opposing portions of said pontoon with respect to said width dimension;

a plurality of leg assemblies coupled to said pontoon, each of said plurality of leg assemblies being substantially H-shaped (i) with at least two vertical members coupled to one another by at least one horizontal member, and (ii) with portions of said vertical members coupled to said pontoon at said recesses associated with one of said pairs thereof while being fitted within the confines of said recesses, wherein each of said plurality of leg assemblies extends beyond said height dimension of said pontoon while remaining within said length and width dimensions of said pontoon, and wherein said vertical members coupled to one side of said pontoon lie in a first plane and said vertical members coupled to an opposing side of said pontoon lie in a second plane, each of said vertical members further having an identical configuration of mounting holes provided therethrough wherein an identical array of said mounting holes is presented in each of said first plane and said second plane;

a support assembly fitted between and coupled to adjacent ones of said plurality of leg assemblies at portions thereof that extend beyond said height dimension of said pontoon, said support assembly fitting within said width dimension of said pontoon;

a plurality of first fenders coupled to at least one of said vertical members in said first plane; and a plurality of second fenders coupled to at least one of said vertical members in said second plane.

17. A system as in claim 16 wherein said pontoon comprises a plurality of water-tight compartments.

18. A system as in claim 16 further comprising at least one access hatch provided in said pontoon.

19. A system as in claim 16 wherein said pontoon has pockets formed therein and centrally positioned along said length dimension thereof, said pockets adapted to receive the fork of a lifting mechanism.

20. A system as in claim 16 further comprising ISO container fittings coupled to said vertical members of each of said plurality of leg assemblies.

* * * * *